US006227366B1

(12) United States Patent
Eckard et al.

(10) Patent No.: US 6,227,366 B1
(45) Date of Patent: May 8, 2001

(54) MODULAR PALLET CAP

(75) Inventors: Terry Lee Eckard, Lancaster, PA (US); Brian Taylor Riding, Sparks, NV (US)

(73) Assignee: R. R. Donnelley and Sons Company, Chicago, IL (US)

( * ) Notice: Subject to any disclaimer, the term of this patent is extended or adjusted under 35 U.S.C. 154(b) by 0 days.

(21) Appl. No.: 09/480,548

(22) Filed: Jan. 10, 2000

Related U.S. Application Data

(63) Continuation-in-part of application No. 09/394,724, filed on Sep. 13, 1999, now abandoned, which is a continuation of application No. 08/959,252, filed on Oct. 29, 1997, now abandoned.

(51) Int. Cl.[7] ..... B65D 19/00

(52) U.S. Cl. ..... 206/386; 206/586; 206/597; 229/939

(58) Field of Search ..... 206/386, 586, 206/597, 600, 453, 821; 229/125.19, 165, 172, 174, 190, 931, 939

(56) References Cited

U.S. PATENT DOCUMENTS

| | | | | |
|---|---|---|---|---|
| 2,033,994 | | 3/1936 | Mulligan . | |
| 2,324,031 | | 7/1943 | Schiffenhaus . | |
| 2,509,468 | | 5/1950 | Anderson, Jr. . | |
| 3,029,994 | * | 4/1962 | Chapman | 206/386 |
| 3,071,045 | | 1/1963 | Budd . | |
| 3,511,464 | | 5/1970 | Doll . | |
| 3,725,170 | | 4/1973 | Doll . | |
| 3,955,677 | | 5/1976 | Collingwood . | |
| 3,995,736 | | 12/1976 | Lawson et al. . | |
| 4,042,127 | | 8/1977 | Brossia . | |
| 4,212,394 | | 7/1980 | Alley . | |
| 4,385,698 | | 5/1983 | Goguen . | |
| 4,504,497 | | 3/1985 | Kurth et al. . | |
| 4,596,541 | | 6/1986 | Ward, Sr., et al. . | |
| 4,986,418 | | 1/1991 | Gwathmey . | |
| 5,042,665 | | 8/1991 | Liebel . | |
| 5,048,689 | | 9/1991 | McFarland . | |
| 5,069,338 | | 12/1991 | Grigsby . | |
| 5,139,145 | | 8/1992 | Cook . | |
| 5,297,682 | | 3/1994 | Miltenberger . | |
| 5,372,255 | | 12/1994 | Skorski et al. . | |
| 5,473,995 | | 12/1995 | Gottlieb . | |
| 5,533,954 | | 7/1996 | Zogg . | |

* cited by examiner

*Primary Examiner*—Luan K. Bui
(74) *Attorney, Agent, or Firm*—Fitch, Even, Tabin & Flannery

(57) ABSTRACT

A new and improved pallet cap is formed in one flat piece that can be stored flat; and, when it is desired, the flat piece can be easily erected in a pallet cap which can cover a side edge of a stack of material on the pallet. This is achieved by providing a flat sheet of paperboard with an elongated flange having fold lines to allow the flange to be folded to project at an angle to a flat panel which is to lie flat on the top or bottom side of the pallet load. The preferred shape of the pallet cap is generally in the shape of a T with the flange being in the crossbar head of the T and the flat panel being the leg of the T.

7 Claims, 3 Drawing Sheets

MODULAR PALLET CAP

This application is a continuation-in-part application of U.S. patent application Ser. No. 09/394,724, filed on Sep. 13, 1999, now abandoned entitled "Modular Pallet Cap" which is a continuation of Ser. No. 08/959,252, filed on Oct. 29, 1997, now abandoned entitled "Modular Pallet Cap."

FIELD OF THE INVENTION

This invention relates to a pallet cap or cover for covering a top side or a lower side of a load on the pallet, and to method of using the pallet cap.

BACKGROUND OF THE INVENTION

Often, pallet covers are placed over a top and/or bottom sides of a load on the pallet prior to its being banned by straps or prior to it being shrink wrapped with plastic. The invention will be described in connection with an exemplary use of pallet caps which cover a stack of flat sheets of paper or printed signatures loaded onto a pallet. The pallet caps are used to protect the sheet edges along the top and bottom side edges of the stack from being torn or indented by the straps. The pallet caps also protect the edges and corners of the stacked sheets against damage when being hit or bumped during handling, storage or transporting.

The pallets and stacked material thereon often are in different sizes so that a preformed shape of pallet cover sized for a particular size of pallet stack will not usually work for substantially larger or substantially smaller sizes of stacks. By way of example, pallets carrying loads of signatures are often in multiple sizes such as 42" by 42", 43" by 48", 44" by 44" and 40" by 48". A number of proposals have been suggested to cover the top of the stack with several interleaved cap pieces that are adjustable to cover several different sizes of stacks or loads on the pallet. One such proposal is use of four interleaved, pallet caps each having a rigid, preformed, glued corner member which is secured to the top edge of a sheet of paperboard or the like. The four caps are interleaved over the top of the pallet with the rigid, formed, glued corners covering the edges of the top side of the stacked material. One problem with this proposal is that the pallet caps themselves cannot be stored flat as the right angle preformed corner sits upright and takes substantial storage space. That is, these pallet caps cannot be stored flat; and hence, they require considerable storage space. This increases storage costs. Also, the formation of the rigid, glued corners and the gluing attaching to the flat sheet adds to the cost of the pallet caps. Often, pallet caps are discarded after one or several usages; and hence, they should be inexpensive.

Often, it is desired to place the pallet caps on the stack to protect the stack while the stack is being transported by a fork lift truck to a shipping area, where the load is banded and wrapped in plastic. Thus, the pallet caps should remain in position on the load while being transported without the bands thereon to secure the pallet caps to the load.

From the foregoing, it will be seen that there is a need for a new and improved pallet cap that is inexpensive to manufacture, adjustable to various size loads, can be stored flat, and will remain on top of the load prior to being banded to the load by straps.

SUMMARY OF THE INVENTION

In accordance with the present invention, a new and improved pallet cap is formed in one flat piece that can be stored flat; and, when it is desired, the flat piece can be easily erected into a pallet cap having a depending flange to cover a side edge of a stack of material on the pallet. This is achieved by providing a flat sheet of paperboard with an elongated flange having fold line therein along which the flange can be folded to project at an angle to a flat panel which is to lie flat on the top or bottom side of the pallet load. The preferred shape of the pallet cap is generally in shape of a T with the flange being in the crossbar head of the T and the flat panel being the leg of the T.

In accordance with the preferred embodiment of the invention, the flat, horizontal panel of the pallet cap overlying the top of the pallet load is made with sufficient size or are as that the pallet load is made with sufficient size or area so that the pallet cap remains on top of the load when being transported as by a fork lift truck to a shipping area, where the pallet cap is banded to the load and pallet. The large horizontal panel counteracts the gravity pull off the edge pending flange hanging down along the side of the load.

The preferred method of covering a top or bottom side of a stack on a pallet comprises the steps of: storing a plurality of flat pallet cap sheets in a stack; removing a plurality of pallet cap sheets from the stack; folding down a flange portion on the respective pallet sheets to erect the pallet caps; placing each of the folded down flanges of the pallet cap adjacent a side edge of the top or bottom side of the stack; interleaving the flat panels of the pallet caps to cover substantial the top or bottom side of the stack; and banding the stack with straps which indent the folded down flanges of the pallet caps.

By using interleaved caps, the pallet cover may be adjusted to cover various sizes of pallets. Tensioned metal straps or plastic bands are wrapped about the stack to secure it together. The pallet caps cushion the edges of stacked material from being damaged by indentations caused by the straps. The pallet covers may be re-used or discarded after a single or multiple use.

Because the pallet caps are erected from a single, flat sheet of paperboard, such as cardboard with a score line at the fold line, they can be inexpensively manufactured. The score line preferably allows the flange to be easily erected from the flat sheet; and the cut corrugations aid in keeping the flange at a good square corner to resist any memory in the corrugated board sheet tending to pivot the flange back into its planar shape.

DETAILED DESCRIPTION OF THE PREFERRED EMBODIMENT

Figure 1:
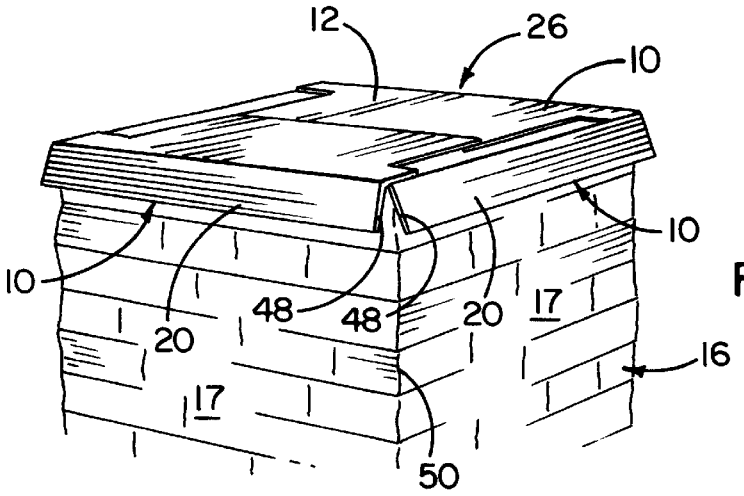
FIG. 1 is a perspective view of four interleaved pallet caps forming a pallet cover for the top of stacked material of a pallet in accordance with a preferred embodiment of the invention.
Figure 2:
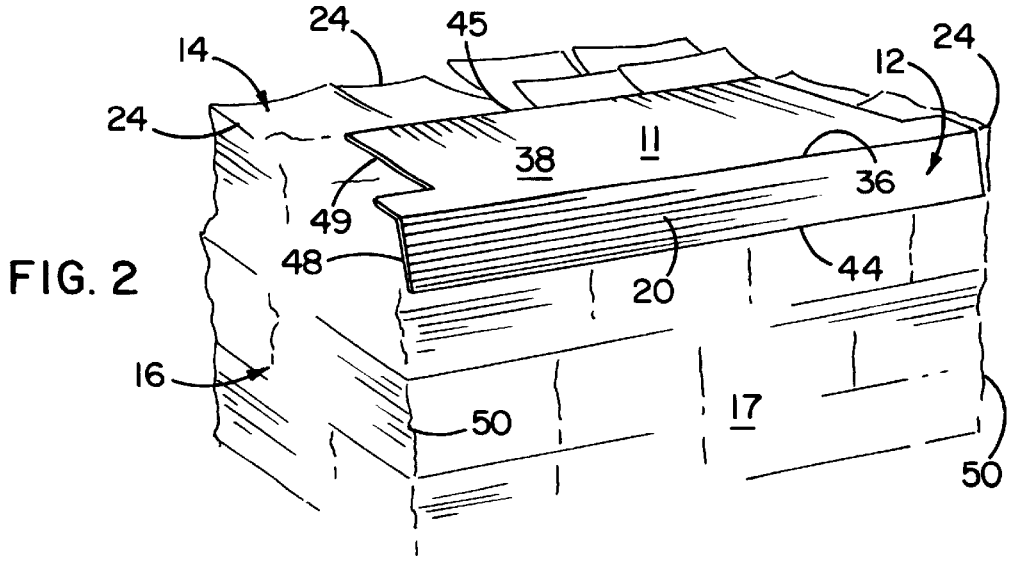
FIG. 2 is an enlarged perspective view of a single pallet cap on a stack of signatures and constructed in accordance with a preferred embodiment of the invention.
Figure 3:
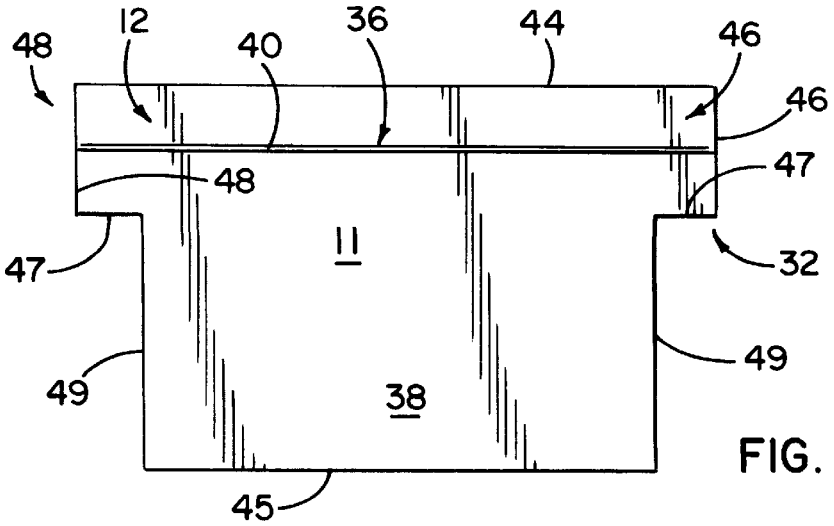
FIG. 3 is a plan view of a flat sheet to be formed into the pallet cap shown in FIG. 2.
Figure 4:
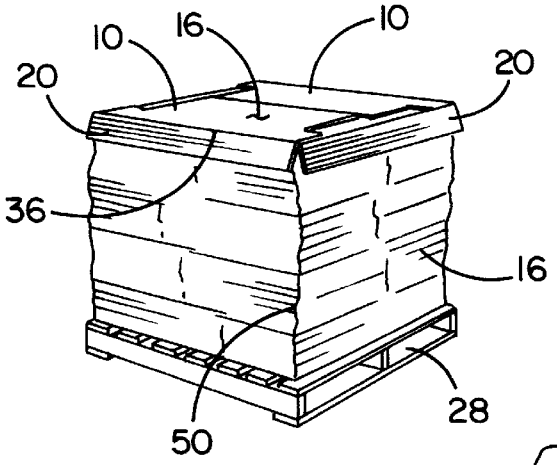
FIG. 4 is a perspective view showing pallet having stack with the pallet cover thereon.
Figure 5:
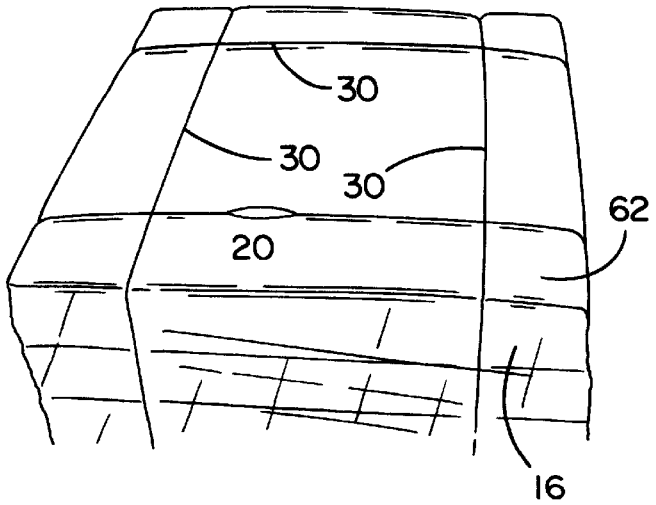
FIG. 5 is an enlarged view of the stacked pallet of FIG. 4 showing straps and a plastic wrap.

As shown in the drawings for purposes of illustration, the invention is embodied in a pallet cap 10 (FIGS. 2 and 3) which has a horizontal portion 11 for positioning on a horizontal side, either a top side 14 of a pallet load or stack 16 or a bottom side 18 (FIG. 4 of the pallet stack 16. A vertical side flange 20 on the pallet cap (FIG. 2) covers an edge 24 of the stack, as best seen in FIG. 2). As best seen in FIG. 1, usually four pallet caps 10 are interleaved to form a pallet cover 26 for covering the top or bottom side of the stack. As best seen in FIG. 4, the stack is mounted on an underlying pallet 28 usually adapted to be lifted and transported by a forklift truck. The stack of signatures is banded with tensioned straps 30 (FIG. 5) of metal or plastic with the edges 24 of the stacked material being protected or cushioned by the cap flanges 20 from indentations by the straps.

In accordance with the present invention, the pallet cap 10 is formed from a flat sheet 32 (FIG. 3) of paperboard, which can be stored flat and usually in a stack of flat sheets without the vertical side flange 20 bring erected. Upon removal from the stack, the flat, planar pallet cap sheet 32 is brought to the stack 16 and the side flange 20 is erected at a fold line 36 (FIG. 3) by bending down a narrow strip portion of a cover sheet head panel 12 to be substantially at right angles to the remainder of the flat sheet, which is placed on the top side 14 of the stack. The preferred fold line is defined by a score line 40 (FIG. 3) in the head panel 12 of the cap cover sheet. Preferably, the flat sheet 32 is comprised of the head or flange panel 12 and the larger leg panel 38. The cover sheet is preferably in the shape of a T with the head panel 12 being the crossbar or head of the T, and the leg of the T being the flat leg panel 38.

Figure 3A:
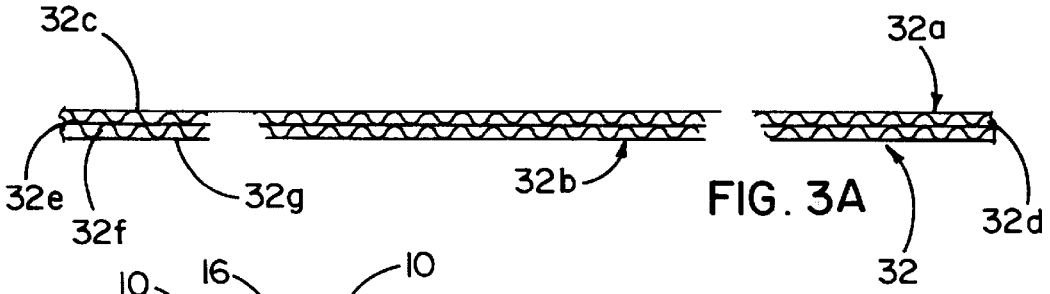
FIG. 3A is an enlarged cross-sectional view of the paperboard flat sheet taken along the fold line shown in FIG. 3.

The preferred flat sheet 32 is formed with an upper and lower, corrugated plies 32*a* and 32*b* (FIG. 3A) with the upper ply 32*a* having a upper, planar, paper sheet layer 32*c* and an internal corrugated layer 32*d*. The lower side of the corrugated layer is also attached to a middle, planar paper sheet layer 32*e*. The lower ply 32*b* includes a lower, corrugated layer 32*f* which is attached to the middle, planar layer 32*e* and a lower, planar, paper sheet layer 32*g*. The preferred score line 40 cuts the upper layer 32*c* and cuts into the upper corrugated layer 32*d*. The middle paper layer 32*e* need not be cut although some cuts may occur therein during the scoring operation. The lower corrugated layer 32*f* and bottom paper layer need not be scored. When the flange 20 is bent down, the cut corrugation may have portions abutting one another at the cut to keep the flange at a substantially right angle to the horizontal panel 12. The number of plies for the corrugated sheet 32 may be varied from two plies and still fall within the purview of the invention.

In accordance with the preferred embodiment of the invention, the horizontal portion 11 of the cap 10 is made sufficiently large so that it keeps the cap 10 on the pallet as it is being transported by a fork lift truck to a place to be banded. By way of example only, it has been found that a horizontal portion of about 20" in length for a flange 20 having a 39" length is sufficient for pallets in the size range of 42" by 42" to 44" by 48". Preferably, the size and/or area of the horizontal portion 11 should be greater than the size and/or area of the depending flange 20. While the preferred shape of the cap is that of a T, the shape may be changed from that of a T and still fall within the purview of the appended claims.

Referring now in greater detail to the invention, the head panel 12 has the score line 40 being parallel to a top edge 44 (FIG. 3) of the flat sheet 32. This score line is located slightly below the midpoint in the head panel 12 and in its arm portions 46 of the T-shaped body. The preferred T-shaped panel sheet 32 has a bottom edge 45 parallel to the top edge 44 with the bottom edge being shorter by the distance of the width of arm edges 47 for the respective pair of arm portions 46. The opposite, vertical sides of the T-shaped, flat sheet are defined by an upper arm vertical edge 48 and a longer, vertical edge 49 in the leg panel 38 below the arm portions 46. A score line 40 is preferred to a squeezed fold line as it keeps the flange 20 at a sharper angle to the top horizontal portion of the head panel 30 than will a flange bent down from a squeezed or crease kind of fold line.

To cover the top side 14 of the stack 16, four pallet caps 10 are interleaved, as best seen in FIG. 1 with each cap having its vertical side flange 20 located along one of the edges 24 of the stack 16 and depending downwardly along a vertical side 17 of the stack. The fold lines 36 of the respective caps 10 are located at the edges 24 of the stack with adjacent, vertical end walls 48 of the side flanges 20 meeting at vertical corners 50 (FIG. 1) for the stack. In the process of interleaving the pallet caps 10, a first pallet cap is placed on the stack, as shown in FIG. 2 in position; and then the leg panel 38 of a second cap may be slid under the leg panel 38 (shown in FIG. 2) with its head panel 12 extending along the adjacent, upper edge and with end wall 50 of its side flange 20 meeting the end wall of the first cap 10. The illustrated flat, leg panels 12 are sufficiently long to extend to approximately 50% of the stack width or breadth so that when interleaved and positioned on the smallest size of pallet stack, the entire top of the stack is covered. In other instances, such as when used with larger sizes of pallet stacks, the entire middle of the top side of the stack may not be covered, as shown by the caps 10B of FIG. 7 or 10C of FIG. 8.

By way of example only, and not by way of limitation, a specific example of the flat sheet 32 to be formed into the illustrated pallet cap 10, shown in FIG. 2, will now be described. The top, horizontal edge 44 (FIG. 3) of the flange and head panel may be 39 inches wide; and the lower, horizontal edge 45 is 32 inches wide. Each arm width portion edge 47 is 3.5 inches. The vertical end walls 48 of the arms are 8.25 inches in height. The height of each leg panel edge 49 is 15.75 inches providing a composite height o twenty-four inches along the vertical side of the flat sheet. The fold line 36 is located 4.75 inches down from the top edge 44 of the flat sheet 32. This provides a horizontal portion 11 of 19.25 inches length and sufficient width for resisting the downward pull of the depending flange, which is 4.75 inches vertically and 39 inches horizontally. This is sufficient to keep caps in the position of FIG. 1 while being transported to a shipping area to be banded to the load. Manifestly, the 4.75 inches for the vertical flange may be made shorter or longer than 4.75 inches depending on the user's desires.

One method of using four interleaved pallet caps 10 will be explained in connection with FIG. 7. Four pallet cover sheets designated 32A, 32B, 32C and 32D are interleaved, leaving a central opening 60 which is not covered by the top horizontal portions 11 of the 15 respective, interleaved caps.

Figure 6:
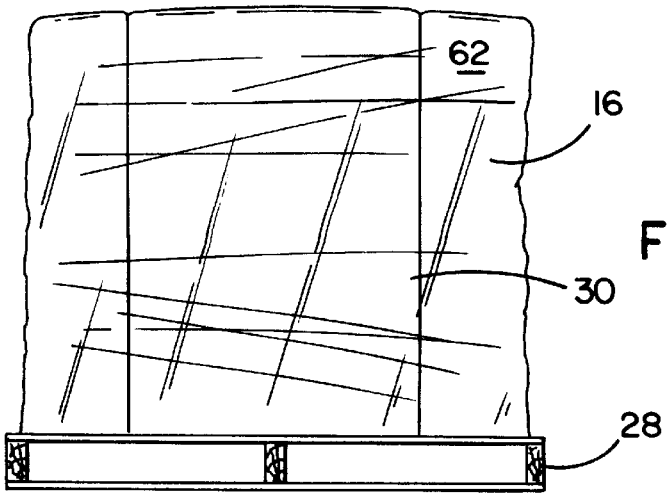
FIG. 6 is a front, elevational view of the stacked pallet of FIG. 4.

More specifically, bottom edges 45A, 45B, 45C and 45D of the respective pallet cover sheets define the sides of the opening 60. A similar but smaller opening 60 (FIG. 8) has its sides defined by the four respective bottom edges 45A, 45B, 45C and 45D when the four sheets are brought closer together. The same sheets may be interleaved either to extend to cover a larger pallet size, such as a 44" by 48" pallet size in FIG. 7, or a smaller pallet size, such as a 42" by 42" size in FIG. 8. A wrap of plastic 62 (FIGS. 5 and 6), which is usually a shrink wrap plastic is wrapped about the four vertical sides of the load as well and may cover the four depending flanges of the pallet caps 10. The bands 30 also secure the pallet caps to the load an to the pallet 28.

Figure 7:
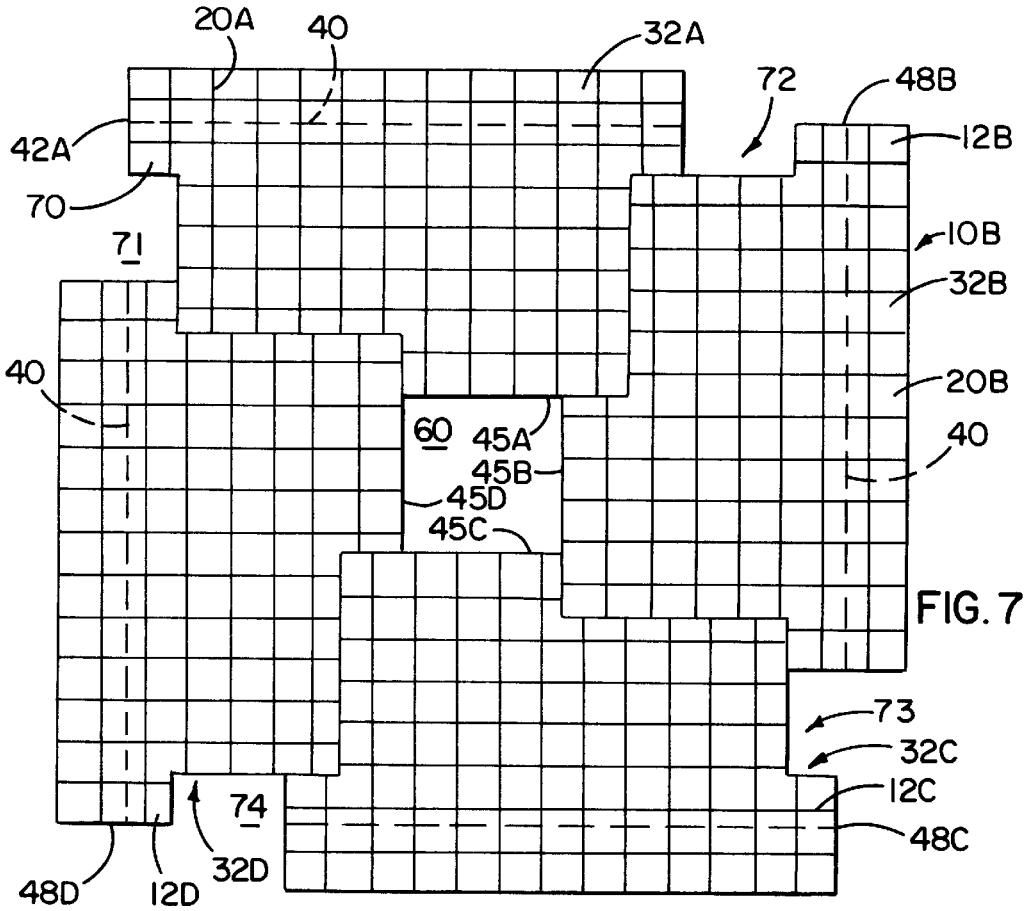
FIG. 7 is a plan view of how to interleave four paperboard blanks into pallet caps to cover a predetermined size of pallet.
Figure 8:
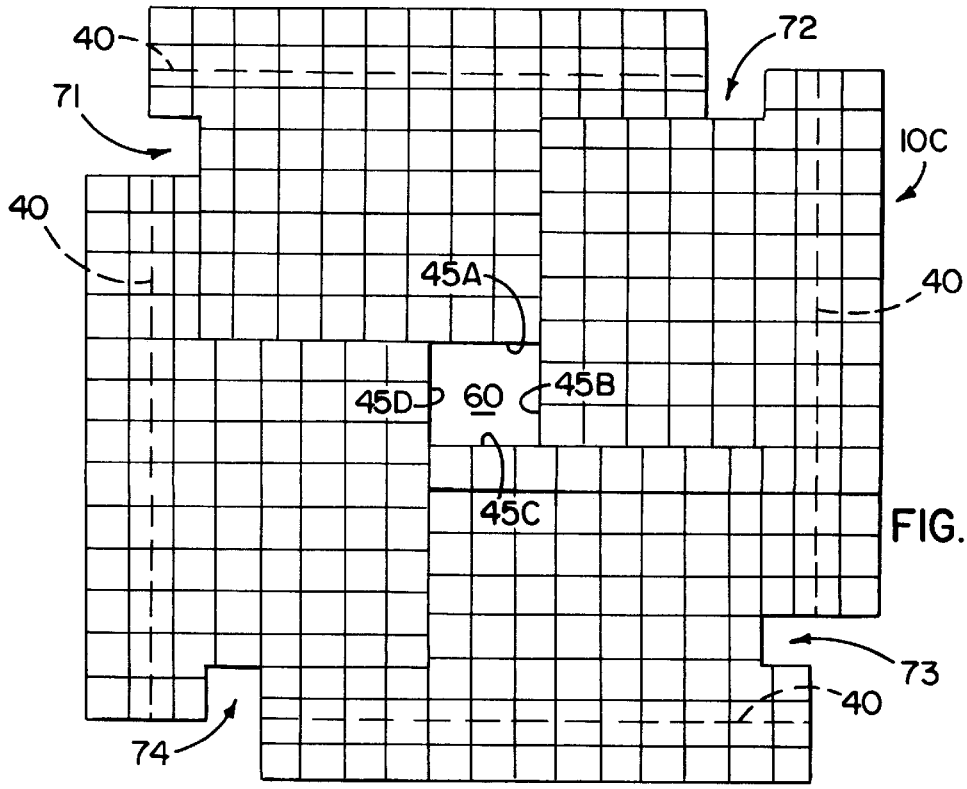
FIG. 8 is a plan view of how to interleave four paperboard blanks into pallet caps to cover a pallet of a smaller size than that of FIG. 7.

When the panels are interleaved, as shown in FIG. 7, and when the flanges are bent down, a corner 4E for the pallet load will be covered partially by head portion 12A with a slight opening or space 71 in the pallet cover 26 being present adjacent the corner 48A between adjacent pallet caps 32 and 32D. At a corner 48B for the pallet load, when the flange 20B is bent down, a portion 12B of the head panel will be covering the corner 48B with an opening 72 in the pallet cover 26 being adjacent thereto. At corner 48C, a portion 12C of the head panel will be covering the corner 48C with a small opening 73 in the pallet cover 26 being adjacent thereto. At corner 488D, a portion 12D of the head panel will be covering the corner 48D with a small opening 74 being present in the pallet cover 26 between adjacent portions of interleaved pallet caps 32C and 32D.

While small spaces exist at the center opening 60, and openings 71, 72, 73 and 74 adjacent the corners of the pallet load, the four interleaved pallet caps cover substantially all of the corners and the upper edges of the pallet load with the depending flanges 20 of the respective four pallet caps. The interleaved pallet caps shown in FIG. 8, have similar but smaller openings 71, 72, 73 and 74 adjacent the corners of the pallet load.

The preferred corrugated sheets may have the corrugations run in either direction with respect to the score line 40, which also can be made at the time of die cutting the flat sheets 32 into their T-shape. Herein, the corrugations run in the same direction as the score line 40. The fold line 36 may be a creased line or formed in other manners beside the preferred scoring. Also, the particular location of the fold line may be changed from that described herein. Various materials may be used for the pallet caps other than the describe paperboard. In the preferred method, the erecting of flanges 20 can be done before the flat sheet 32 is brought to the stacked material; or the flat sheet can first laid on a side of the stack and then the folded flange 20 can be bent down from the fold line. It is to be understood that the pallet caps can be used with the leg panel 38 being along a vertical side 17 of the stacked material, and with the flange 20 being horizontal across the top side 14 of the stacked material. Also, the fold line can be made with one or two score lines or creases rather than the single score line 40 described herein.

What is claimed is:

1. A pallet cover sheet erectable to cover an upper side edge of a stacked material loaded on a pallet, said pallet cover sheet comprising:

a one-piece, flat cover sheet body made of paperboard stock;

a flat top panel on the cover sheet body for laying on the top of the stacked material of the stack;

an elongated, foldable, side edge flange on the cover sheet body integrally joined to the flat top panel for being bent down at right angles to rover the edge of the stacked material arid to depend along a vertical side of the stacked material;

a hinge line on the cover sheet body adjacent the foldable, side edge flange to be located at the upper side edge of the stacked material; and the elongated, foldable, side edge flange extending for a length longer than the length of the flat top panel;

the sheet cover body comprising upper and lower corrugated plies;

a planar paper sheet layer being positioned between the upper and lower corrugated plies;

a score line cutting the upper corrugated ply and the lower corrugated ply being substantially uncut to provide the hinge line between flat top panel and the side edge flange.

2. A pallet cover in accordance with claim 1 wherein the side edge flange and the flat top panel define a substantially T-shape for the cover sheet body with the side edge flange forming an upper crossbar head of the T-shape and the flat top panel forming the upright leg of the T-shape.

3. A pallet cover in accordance with claim 1 wherein the hinge line is in the head of the T-shape.

4. A pallet cover in accordance with claim 1 wherein an upper paper layer on the upper corrugated ply is cut; and the planar paper sheet layer between the upper and lower corrugated plies is substantially uncut.

5. A pallet for carrying a load comprising:

a pallet; and a load on the pallet having four sides with a rectangular, upper edge about the four vertical sides of the load;

a plurality of interleaved pallet caps of paperboard sheet stock positioned to cover an end of the load;

each of the pallet caps being of one integral piece and having a flat panel laying on the top side of the load;

the pallet caps being flat and planar for stacking one upon another for storage prior to use thereof with the load;

a single fold line in each pallet cap located adjacent one of the rectangular edges of the side of the load; and a single folded down flange on each pallet cap adapted to fold and to extend along a vertical side edge of the load from the fold line each of the pallet caps having the shape of a T with the flange being in the head of the T and the flat panel being a leg of the T, the flange being longer than the flat panel.

6. A pallet in accordance with claim 5 where straps are wrapped about the pallet and the pallet cap with the pallet caps cushioning against strap indentations into the upper side edges of the load.

7. A pallet cap and a pallet of stacked material with the cap covering and protecting a top side and an upper side edge of the stacked material loaded on pallet, a combination comprising:

a pallet:

stacked material vertically stacked on the pullet;

tensioned straps bending the stacked material to the pallet;

a one-piece sheet body for the pallet cap made of corrugated board and having a T-shape;

a flat, horizontal panel on the T-shaped sheet body for laying on the top of the stacked material adjacent the side edge of the stack;

a single elongated, folded, side edge, vertical flange on the T-shaped sheet body integrally joined to the flat, horizontal panel and being bent down at right angles to cover only one edge of the stacked material, and to depend along only one vertical side of the stacked material;

the vertical flange being longer than the horizontal panel and extending-beyond the edges of the horizontal panel to define the T-shape for the sheet body;

a score line on the T-shaped sheet body adjacent the foldable, side edge, vertical flange to be located at the upper side edge of the stacked material; and the flat, horizontal panel having an area larger than the area of the vertical flange to retaining the pallet cap on the stacked material.

* * * * *

UNITED STATES PATENT AND TRADEMARK OFFICE

CERTIFICATE OF CORRECTION

PATENT NO. : 6,227,366 B1
DATED : May 8, 2001
INVENTOR(S) : Terry Lee Eckard, et al.

It is certified that error appears in the above-identified patent and that said Letters Patent is hereby corrected as shown below:

Claim 1, column 6,
Line 1; change "rover" to -- cover --.
Line 2; change "arid" to -- and --.

Claim 6, column 6,
Line 55; change "where" to -- wherein --.
Line 56; change "cap" to -- caps, --.

Claim 7, column 6,
Line 61; after "on" insert -- the --.
Line 65; change "pullet" to -- pallet --.
Line 66; change "bending" to -- banding --.

Claim 7, column 8,
Line 2; after "extending" delete the "-" (hyphen).
Line 8; change "retaining" to -- retain --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*